United States Patent [19]

Bini

[11] Patent Number: 4,669,231

[45] Date of Patent: Jun. 2, 1987

[54] BUILDING CONSTRUCTION AND METHOD UTILIZING MODULAR COMPONENTS

[75] Inventor: Dante Bini, San Francisco, Calif.

[73] Assignee: Binistar International, N.V., Curacao, Netherlands Antilles

[21] Appl. No.: 839,355

[22] Filed: Mar. 13, 1986

[51] Int. Cl.[4] ..... E04B 1/34

[52] U.S. Cl. ..... 52/2; 52/293; 52/299; 248/631

[58] Field of Search ..... 52/2, 293, 166, 299, 52/DIG. 11, 646, 480, 292, 393; 248/631

[56] References Cited

U.S. PATENT DOCUMENTS

| | | | |
|---|---|---|---|
| 2,743,487 | 5/1956 | Kuhlman | 52/480 X |
| 3,057,054 | 10/1962 | Barnes | 52/2 X |
| 3,092,854 | 6/1963 | Manhart | 52/2 X |
| 3,415,719 | 12/1968 | Telkes | 52/2 X |
| 3,682,431 | 8/1972 | Vivian | 248/631 |
| 3,724,142 | 4/1973 | Worthington | 52/299 X |
| 3,754,364 | 8/1973 | Ice | 52/299 X |
| 3,855,744 | 12/1974 | Miram | 52/293 X |
| 4,567,696 | 2/1986 | Malez | 52/2 |

*Primary Examiner*—William F. Pate, III
*Assistant Examiner*—Creighton Smith
*Attorney, Agent, or Firm*—Flehr, Hohbach, Test, Albritton & Herbert

[57] ABSTRACT

Building construction supported by the ground, having a floor, sidewalls mounted upon the floor and a roof supported by the sidewalls and the floor. A plurality of spaced apart inflatable flexible elements are provided which are disposed between the floor and the ground. Adjustable linkages anchor the floor to the ground and serve to urge the floor toward the inflatable flexible elements to provide a stable and relatively level support for the floor as well as the sidewalls and roof.

18 Claims, 25 Drawing Figures

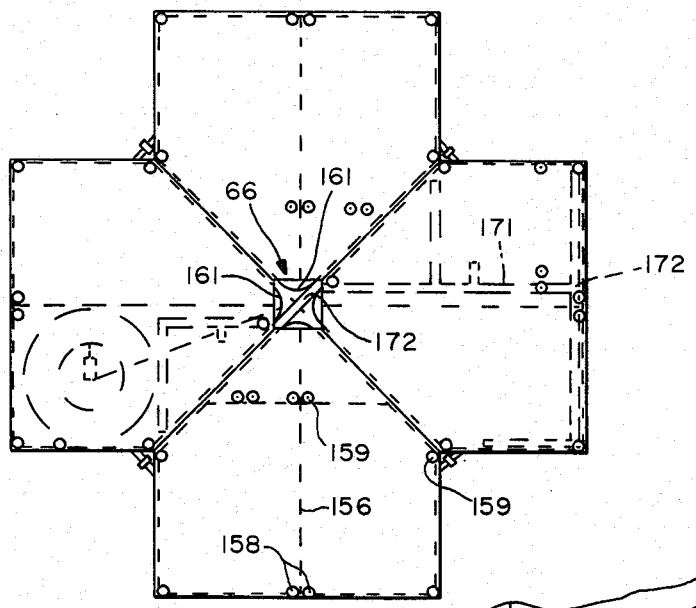
FIG.—20
FIG.—21
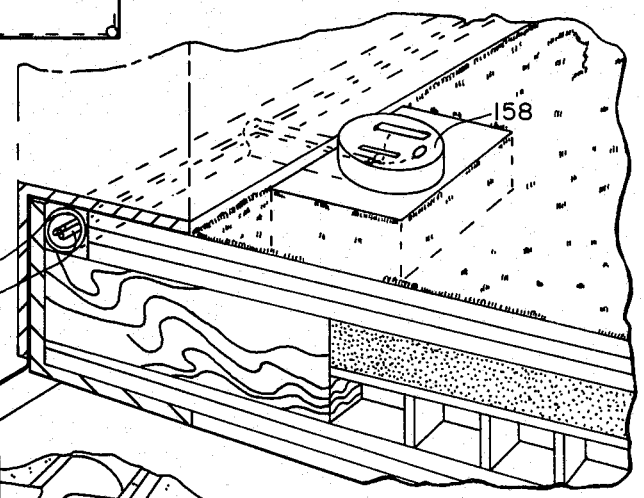
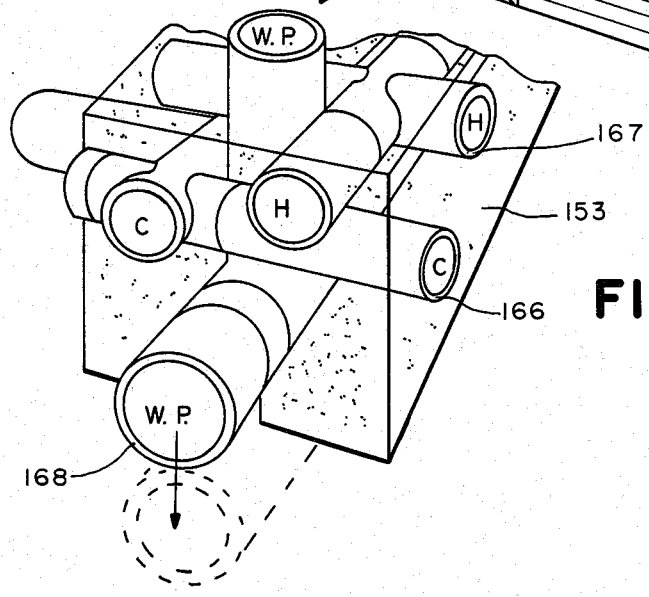
FIG.—22

BUILDING CONSTRUCTION AND METHOD UTILIZING MODULAR COMPONENTS

This invention relates to a building construction and method utilizing modular components which can be readily shipped in disassembled form and readily assembled to provide a rapidly erectable enclosed shelter.

In general it is an object of the present invention to provide a building construction and method utilizing modular components which can be shipped in disassembled form and which can be readily assembled.

Another object of the invention is to provide a building construction and method of the above character in which the modular components can be readily packaged in a single conventional container for shipment to the desired location.

Another object of the invention is to provide a building construction and method of the above character which can be erected in a relatively short period of time by unskilled workers.

Another object of the invention is to provide a building construction and method of the above character which can be erected on soil of various types and conditions.

Another object of the invention is to provide a building construction and method of the above character in which extensible plug-in connections are provided for connecting to existing local water, electricity and rain/-sewage systems.

Another object of the invention is to provide a building construction and method of the above character which lends itself to being erected on inflatable elements which can serve as the supporting foundation for the buiding.

Another object of the invention is to provide a building construction and method of the above character in which the building can be securely anchored to the ground.

Another object of the invention is to provide a building construction and method of the above character in which it is possible to adjust the anchorage so that the inflatable elements can be utilized to permit the building to float above the ground in the event of flooding.

Another object of the invention is to provide a building construction and method of the above character in which the components are waterproofed, insulated and metal framed.

Another object of the invention is to provide a building construction and method of the above character which can be utilized to provide a housing for a family including bedrooms, bathrooms, closets, living and dining rooms, a kitchen and a laundry room.

Another object of the invention is to provide a building construction and method of the above character in which various types of layouts for the living arrangements can be provided.

Another object of the invention is to provide a building construction and method of the above character which can be supplied with inflatable equipment to elminate the necessity of use of a crane for erection.

Another object of the invention is to provide a building construction and method of the above character in which desired accessories such as water tanks, waste tanks, kitchen, bath and laundry equipment, furniture, heating and air conditioning equipment can be accommodated.

Another object of the invention is to provide a building construction and method of the above character which can be readily disassembled.

Another object of the invention is to provide a building construction and method of the above character which can be utilized for emergency housing.

Another object of the invention is to provide a building construction and method of the above character which can be utilized to provide low-cost housing.

Another object of the invention is to provide a building construction and method of the above character which can be totally manufactured off-site in a simple and relatively inexpensive assembly plant.

Additional objects and features of the invention will occur in connection with the description of the preferred embodiment which is set forth in connection with the accompanying drawings.

FIG. 20 is a plan view of the floor utilized in the building construction shown in FIG. 1 and showing the electrical and water systems.

FIG. 21 is an enlarged cross-sectional view showing a portion of the floor having electrical connections and floor sockets provided therein.

FIG. 22 is an isometric view showing the manner in which the water system is incorporated in the building construction shown in FIG. 1.

In general, the building construction is of a type adapted to be supported by the ground. It is comprised of a floor with sidewalls mounted on the floor and with a roof supported by the sidewalls and the floor. A plurality of spaced apart inflatable flexible devices are disposed between the floor and the ground upon which the building construction is to be supported. Adjustable anchors are provided for securing the floor, sidewalls and roof to the ground and for pulling the floor toward the inflatable, flexible devices to provide a stable support and foundation for the floor.

Figure 1:
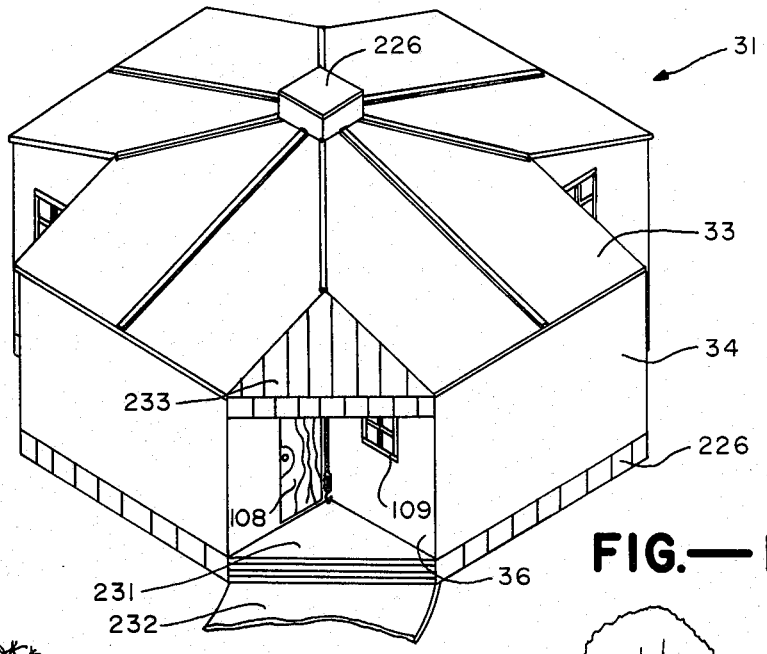
FIG. 1 is an isometric view of a building incorporating the building construction and method of the present invention.
Figure 2:
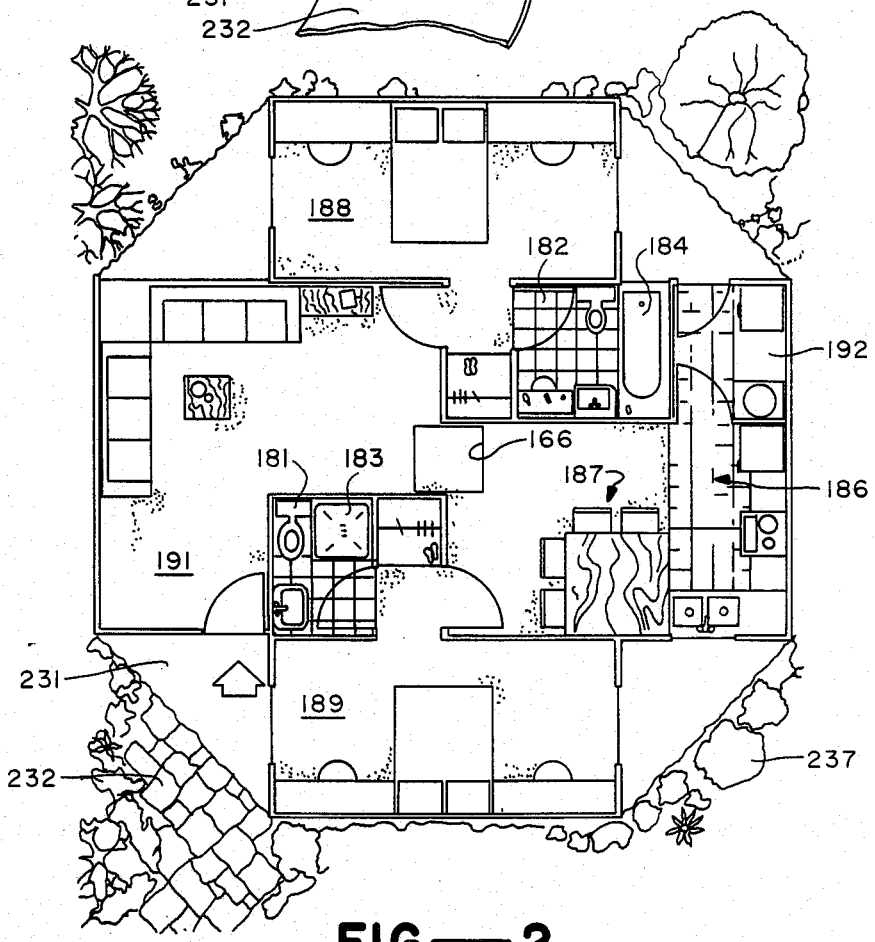
FIG. 2 is a plan view of the interior of the building shown in FIG. 1 showing the typical floor plan.

More in particular, as shown in the drawings, the building construction can take the form of a single family dwelling 31 such as shown in FIG. 1. As hereinafter described more in detail, the building construction including the dwelling 31 shown in FIG. 1 is constructed of a plurality of modular components. These modular components comprise the floor components 32, roof components 33, sidewall components 34, and door and window corner components 36. A floor plan of a typical dwelling unit is shown in FIG. 2 and will be described more in detail hereinafter after the construction of the various modular components has been described.

Figure 3:
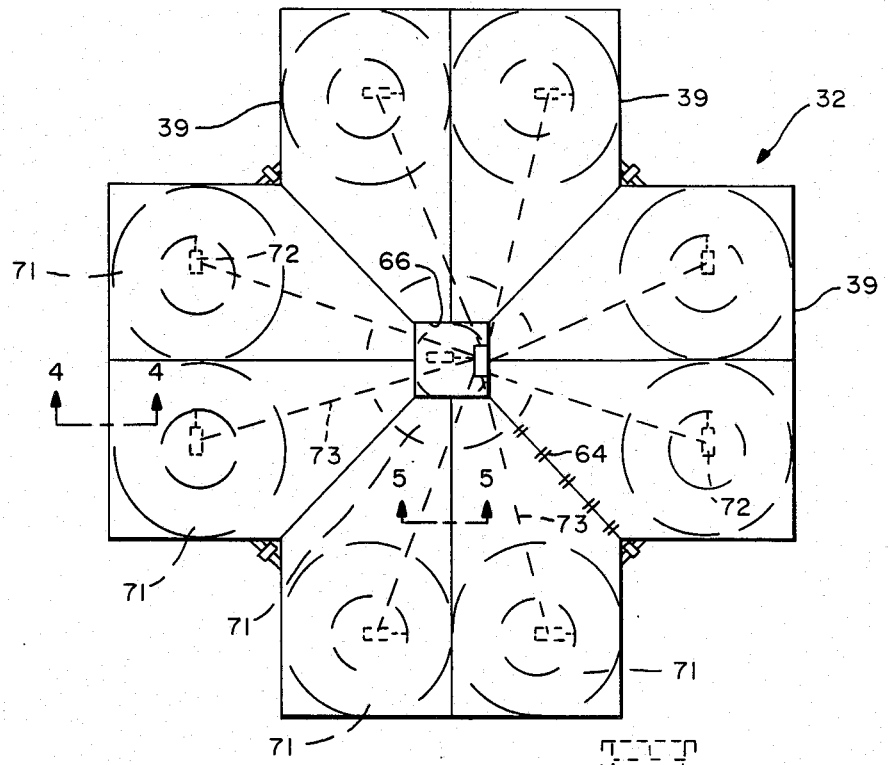
FIG. 3 is a top plan view of the floor utilized in the building construction and showing the use of inflatable elements for supporting the floor.

As can be seen in FIG. 3, four modular floor components 39 have been provided each of which consists of two floor panels 41. Each of the floor panels 41 is provided with an outer edge 42, a side edge 43 which is perpendicular to the outer edge 42, intermediate edge 44 which is parallel to the side edge 43, an inner edge 46 which is parallel to the outer edge 42, and an inclined edge 47 which is inclined at 45' with respect to the inner edge 46 and the side edge 43. Thus as can be seen, each of the floor panels 41 consists of a rectangular portion and a truncated triangular portion. The intermediate edges 44 of the two panels which comprise each of the floor components 39 are fastened together for swinging movement by suitable means such as a hinge 48.

Figure 4:
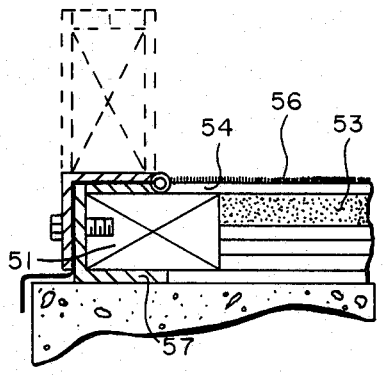
FIG. 4 is a cross-sectional view taken along the line 4—4 of FIG. 3.
Figure 6:
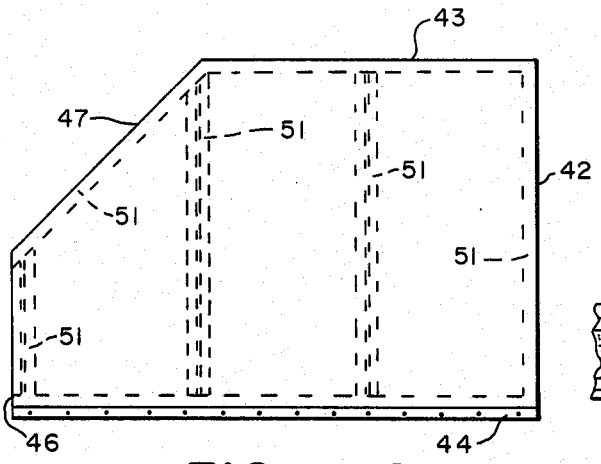
FIG. 6 is a plan view showing one-half of a modular component or panel utilized in the floor shown in FIG. 3.
Figure 5:
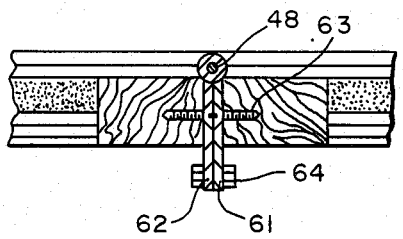
FIG. 5 is a cross-sectional view taken along the line 5—5 of FIG. 3.
Figure 7:
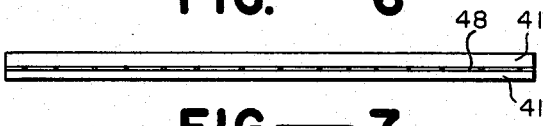
FIG. 7 is a side elevational view showing one of the modular components utilized for the floor in a folded position.

The floor panels 41 can be formed of any suitable construction materials so long as they provide the desired rigidity and strength while being relatively lightweight. By way of example as shown in FIG. 4, the frame for each of the floor panels 41 can be formed of framing members 51 formed of a suitable material such as wood. The interior of the floor panels can be formed of laminated wood or other suitable material as shown in FIG. 4. The remaining space provided in the panel can be filled with suitable structural and insulating material 53 such as reinforced concrete or various types of foam products where lightness is desired. Another layer 54 of wood can then be placed over the framing members 51 and the material 53 as shown in FIG. 3. A suitable floor covering can be placed over the layer of wood 54 as for example, tile or carpeting 56. The edges of the floor panels of 41 can be reinforced by a suitable material such as metal angles 57 which can be secured to the framing member 51 by a suitable means such as screws (not shown). The hinge 48 has leaves 61 and 62 which are secured to the intermediate edges 44 of the floor panels by suitable means such as screws 63. As can be seen from FIG. 5, the leaves 61 and 62 of the hinge 48 extend beyond the framing members 51 so that when the two panels are opened up to form a floor component the downwardly extending portions of the leaves can be fastened together by a suitable means such as bolts 64 to give additional rigidity to the floor components.

When erecting a dwelling 31 as hereinafter described, the floor components can be mounted upon a conventional poured concrete foundation or alternatively can be supported on concrete blocks if the soil conditions warrant. When four of the floor components are assembled to provide the floor 32 for the dwelling, the metal angles 57 secured to the abutting inclined edges 47 can be fastened together by suitable means such as bolts (not shown) so as to provide a unitary structure. Because of the truncated nature of the floor panels 41 as hereinbefore described, when the floor panels are assembled there is provided a central rectangular opening 66 which gives access to various facilities and systems required for the dwelling as for example, gas, water, electricity, sewage and the like as hereinafter described.

The construction of the floor 32 as hereinbefore described particularly lends itself to being supported by a plurality of inflatable elements 71 as shown in broken lines in FIG. 3 acting as a supporting foundation. As also shown in FIG. 3, these inflatable elements 71 can take the form of any of the flexible annular tubes with the inflatable elements 71 being positioned so that one of the inflatable elements is secured to the bottom side of each of the floor panels 41 in such a manner so that the panels 41 can be shipped in folded relationships with the inflatable elements deflated. Thus as shown, there can be provided a total of eight of such inflatable elements 71 for the use in supporting the floor 32 of the dwelling 21 plus one which is located on the ground at the center of the building.

Means is provided facilitating inflation of the inflatable elements 71 and includes a cylinder 72 which is provided with each of the inflatable elements 71. Each container contains a suitable gas such as compressed air for inflating the inflatable element. If desired, means as indicated by the broken lines 73 can be provided for remotely actuating the cylinders 72 from the central opening 66 so that all of the inflatable elements 71 can be inflated substantially simultaneously to support the floor 32 on the ground. Alternately, the inflatable elements can be inflated manually by a hand operated or foot operated air pump. As hereinafter described, it is desirable to provide anchoring means for anchoring the floor to the ground and to pull the floor into engagement with the inflatable elements 71 after they have been inflated so that the floor 32 is firmly supported by the inflatable elements.

The roof 33 of the dwelling 31 is comprised of four roof components 79 each of which is comprised of two roof panels 81. Each of the roof panels 81 is provided with an outer edge 82, a side edge 83 perpendicular to the outer edge 82. It is also provided with a side edge 84 which is parallel to the side edge 83. It is also provided with an inner edge which is parallel to the outer edge 82 and an inclined edge 87 which is inclined with respect to the edges 86 and 83. A hinge 88 is provided for interconnecting the two roof panels 81 to form a roof component 79.

Figure 8:
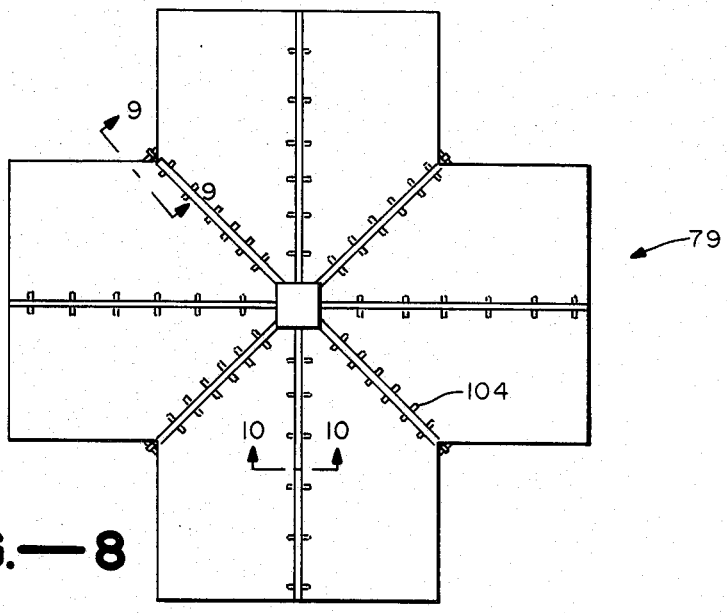
FIG. 8 is a top plan view of the roof utilized in connection with the building construction and method.
Figure 9:
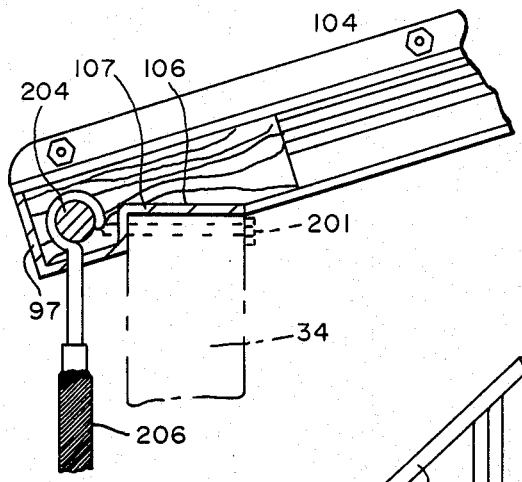
FIG. 9 is a cross-sectional view taken along the line 9—9 of FIG. 8.
Figure 10:
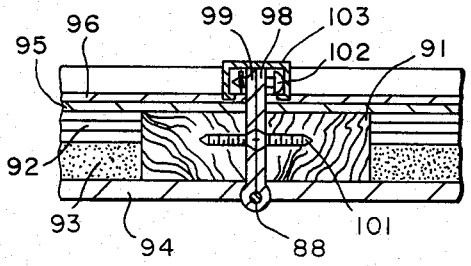
FIG. 10 is a cross-sectional view taken along the line 10—10 of FIG. 8.
Figure 11:
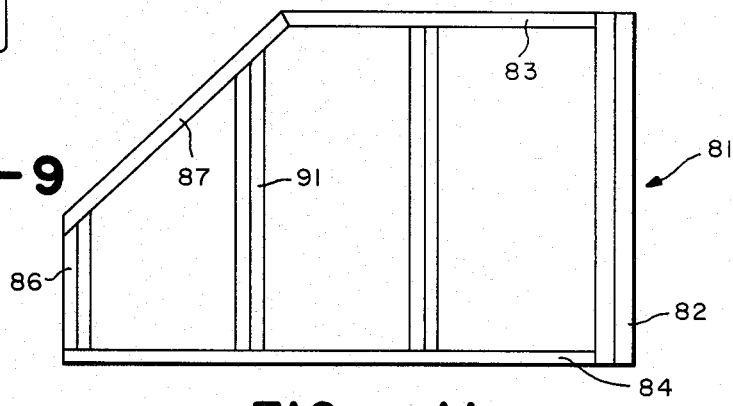
FIG. 11 is a plan view of one-half of one of the modular components utilized for the roof in the building construction shown in FIG. 1.
Figure 12:
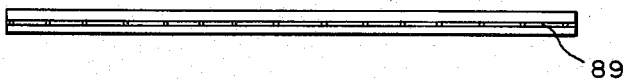
FIG. 12 is a side elevational view of a modular component for the roof being shown in a folded position.

Each of the roof panels 81 can be fabricated in a suitable manner. For example the materials which have been utilized in the floor panels 41 can be utilized. Thus, wood framing members 91 can be provided. The interior can be filled with a laminated wood structure 92 and with a suitable material such as reinforced concrete or foam 93. An interior ceiling covering such as ceiling tile 94 can be disposed on the interior surface of the reinforced concrete 93. A layer of waterproof material 95 can overlay the laminated wood structure 92 and can be covered by a suitable roof tile 96. As with the floor panels 41, the roof panels 81 also can be provided with metal angle 97 reinforcing along the edges. The leaves 98 and 99 of the hinge 88 are secured to the framing members 91 by a suitable means such as screws 101. The outer extremities of the leaves 98 and 99 can be fastened together by a suitable means such as bolts 102 to firmly clamp the two roof panels 81 of each of the roof components 79 together to form a rigid unitary structure. In order to prevent leakage of water through the hinge 98, the leaves 98 and 99 of the hinge can be covered in a suitable manner such as by an elongate rectangular flashing 103. The roof components when arranged in the manner shown in FIG. 8 with their inclined edges 87 abutting can be fastened together by suitable means such as bolts 104 extending through the reinforcing metal angles 97. Suitable waterproofing may be provided along these joints.

The outer lower extremities of the roof panels 81 are provided with a notch 106 extending parallel to the outer edge 82. The notch 106 is reinforced by a metallic member 107 which is adapted to receive the upward extremity of the sidewalls 34 as hereinafter described.

The sidewall 34 is comprised of sidewall components 111 and door and window corner components 112. The door and window corner components 112 have door 108 and windows 109 mounted therein. The door and window corner components 112 consist of panels of wood 113 with each of the panels being provided with a bottom edge 114, a side edge 116 which extends perpendicular to the bottom edge 114, an intermediate edge 117 parallel to the side edge 116, and an inclined edge 118 which extends at an angle with respect to the side edge 116 and the intermediate edge 117. The panels 113 are fastened together by a hinge 121 extending the length of the center side edge 117.

The door and window corner components 112 also can be constructed in a suitable manner such as that described herein before with respect to the floor panels 41 and the roof panels 81. Thus they can be provided with framing members 122 which are filled with a laminated wood structure 123 and with reinforced concrete or other suitable insulating and reinforcing material 124. Exterior paneling 126 can be provided on the exterior surfaces of the panels and interior paneling 127 can be provided on the interior surfaces. Suitable angle members 128 can be provided for reinforcing the edges of the panels and can be secured thereto by suitable means such as screws (not shown). The hinges 121 are provided with leaves 131 and 132 which are secured to the framing members 122 by suitable means such as screws 133. The leaves 131, 132 are provided with portions **131*a* and 132*a* which extend at right angles to the leaves and are adapted to form a compression seal with respect to a flexible, elongate tubular member 136 formed of a suitable material such as plastic. Thus it can be seen that the tube 136 serves to form a weathertight seal between the panels 113**.

Figures 13, 14, 15, 16, 17, 18, 19:
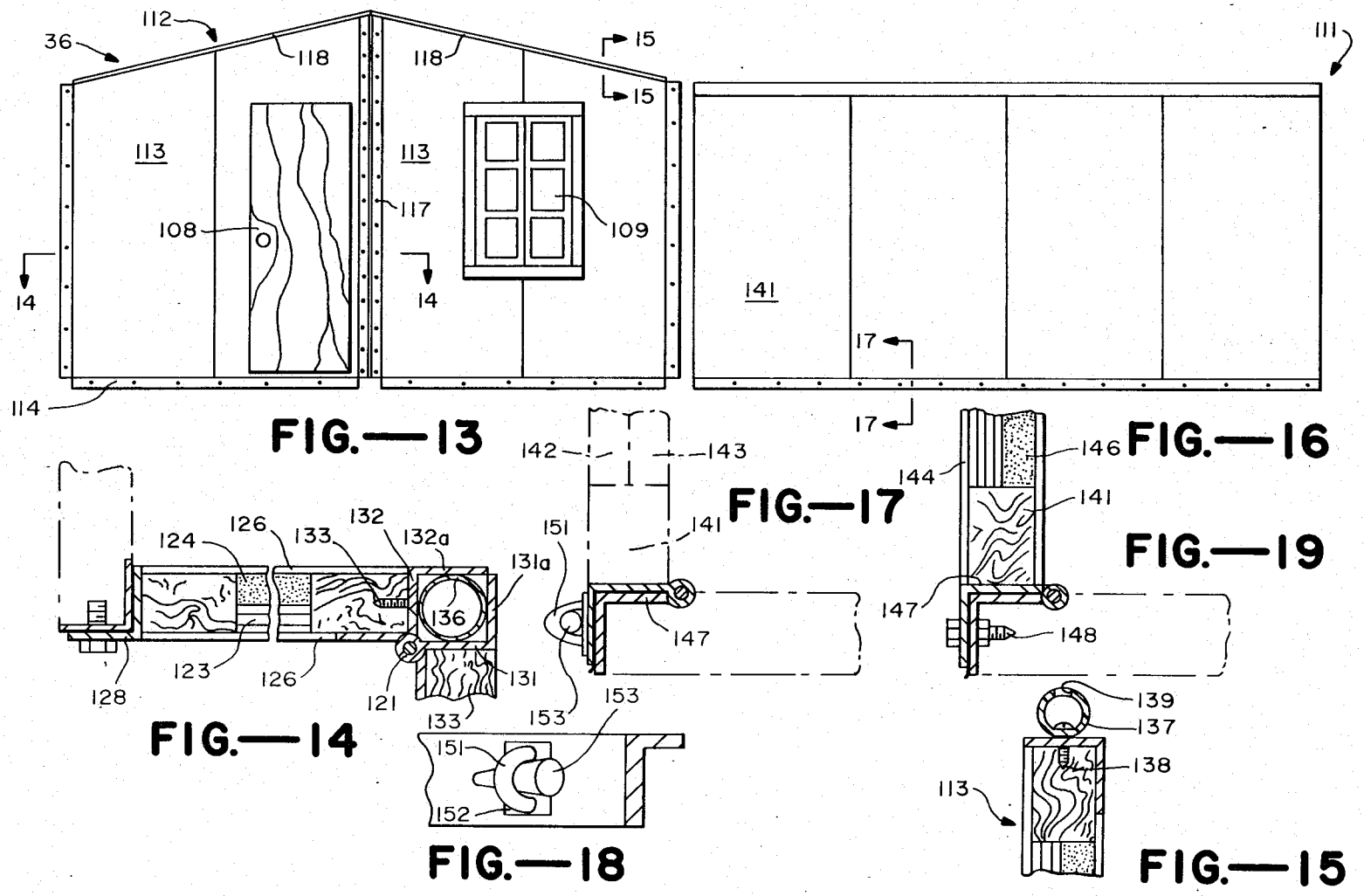
FIG. 13 is an elevational view of a door and window corner panel serving as one of the modular components utilized in the building construction shown in FIG. 1.
FIG. 14 is a cross-sectional view taken along the line 14—14 of FIG. 13.
FIG. 15 is a cross-sectional view taken along the line 15—15 of FIG. 13.
FIG. 16 is a side elevational view of one of the wall panels utilized as a modular component in the building construction shown in FIG. 1.
FIG. 17 is a cross-sectional view taken along the line 17—17 of FIG. 16.
FIG. 18 is an isometric view of the wedge-type connector shown in FIG. 17.
FIG. 19 is a cross-sectional view similar to FIG. 17 but showing use of screws rather than a wedge-type connector.

Additional weatherproofing can be provided between the bottom and top edges of the panels 113. This as shown in FIG. 15, circular tubing 137 is disposed on the upper edge of the panel 113 and is formed of a suitable material such as plastic. The tubing 137 is fastened to the panels 113 by suitable means by screws 138 inserted through holes 139. The tubing 137 serves to provide a weatherproof seal between the upper extremity of the panel 113 and the roof when assembly is completed.

The sidewall components 111 each consist of a single panel. Each panel is comprised of a plurality of framing members 141, the interior of which is filled in by a laminated wood structure 142 and reinforced concrete or other suitable structural and insulating material 143. Exterior and interior wall coverings 144 and 146 are provided as a part of the panels. As with previous panels, reinforcing metal angles 147 can be provided on the exterior surfaces of the sidewall component 111 and can be fastened thereto by suitable means such as screws (not shown). When assembling the sidewall components 111 on the floor components, the angles 147 can be secured to the floor components by a suitable means such as screws 148.

It should be appreciated that various types of fastening means can be utilized which facilitates assembly and erection of the various panels which make up the structure. Thus by way of example there is shown in FIGS. 18 and 19 a construction in which a loop or ring 151 is secured to one of the angle members and extends through a slot 152 in the other angle member which is adapted to receive a wedge 153 to secure the loop 151 as shown in particular in FIGS. 17 and 18.

Various electrical and water capabilities are provided in the floor panels 41 hereinbefore described. As shown schematically in FIG. 20, electrical wiring 156 is provided in each of the floor panels as represented by the broken lines 156 shown in FIG. 20. As shown more in detail in FIG. 21, the electrical wiring 156 is carried in electrical conduit 157 of a suitable material such as metal or plastic which is disposed within the floor panel. This wiring 156 is connected to floor mounted electrical outlets 158 and floor mounted electrical switches 159. The wiring between the floor panels 41 can be interconnected by cables 161 within the central opening 66. From this arrangement it can be seen that electrical service can be readily provided on all areas of the floor emanating from a central electrical supply in the central opening 66.

In a similar manner, gas, water and sewage systems can be mounted within the floor panels 41. By way of example, in FIG. 21 a piping system can be provided in the floor panels. Thus cold water piping 166 formed of a suitable material such as plastic can be provided. Similarly hot water piping 167 can also be provided. Sewage or waste disposal lines 168 formed of a suitable material such as plastic can also be provided. This piping can be brought into the central opening 66 and the floor 33 to facilitate making the connections to the various piping provided in the panels. A typical piping diagram is shown in FIG. 20 in which the piping is schematically represented by the broken lines 171. With the arrangement shown, there is only one connection necessary which need be watertight where unfolding and folding of panels occurs and this is at the point 172. This can be readily accomplished by providing a watertight seal at this connection which is engaged when the panels are unfolded and laid flat.

With the plumbing arrangement shown in FIG. 20, a layout such as that provided in FIG. 2 can be readily accomplished in which there are provided two bathrooms 181 and 182, one of which includes a shower 183 and the other which includes a bathtub 184. There is also provided a kitchen area 186, a dining area 187. In addition there is provided two separate bedroom areas 188 and 189 as well as the living room area 191.

The components for this building construction are fabricated in such a manner so that the panels forming the various components, as for example, the floor components, ceiling components and the corner components can be folded in half and laid flat. This makes it possible for all of the materials for a single family dwelling 31 to be totally manufactured off-site and to be placed in a single container of the type conventionally used for shipping products from one location to another as for example on trucks and shipping vessels. The container containing the components can be transported to the desired location. The container can then be unloaded and erection can be commenced by the use of relatively unskilled labor. Typically, the entire dwelling can be erected in one day by four unskilled laborers.

Figure 23:
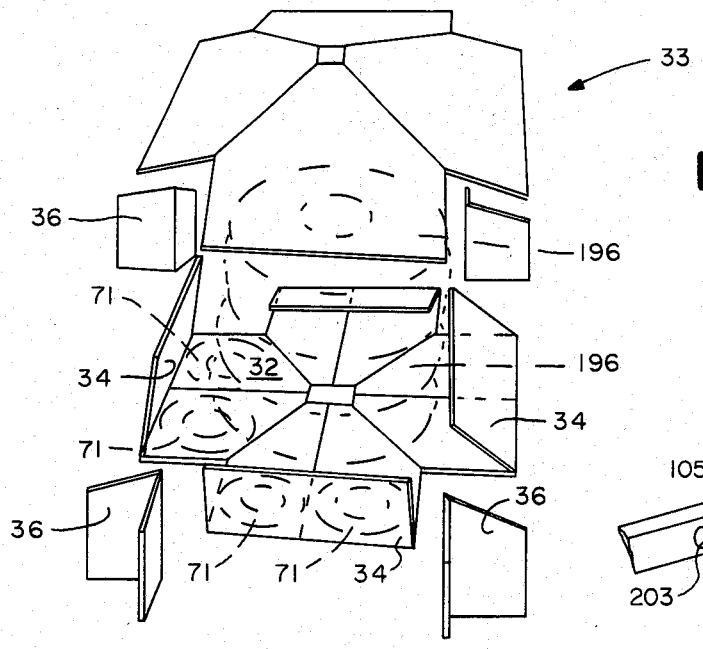
FIG. 23 is an exploded isometric view showing the manner in which the floor, roof, sidewall and corner modular components of the building construction are assembled to provide the building construction shown in FIG. 1.

Let it be assumed that inflatable elements are to be utilized for the supporting foundation of the building. When this is the case, with the inflatable elements 71 secured thereto the floor components are unfolded and bolted together with the inflatable elements disposed below and then interconnected so as to form a rigid unitary structure. After this has been accomplished, the inflatable elements may be inflated the desired amount as hereinbefore described to raise the floor to the desired level above the ground. Anchors of the type hereinafter described can then be inserted into the ground to tie the floor to the ground and to pull the flooring into engagement with the inflatable elements so that the inflatable elements serve as a support foundation and so that the floor is maintained at a level position on the inflatable elements. Thereafter, the sidewalls 54 are positioned on top of the floor 32 in the manner indicated in FIG. 23. The roof 33 is then assembled on top of the floor and the sidewall components 34. After the roof has been assembled, it can be lifted to the desired elevation by a crane. If a crane is not available, the roof can be raised by utilization of stacked tubular flexible inflatable elements 196 which are first positioned below the roof on top of the sidewall components 34. These tubular elements 196 can then be inflated to elevate the roof 23 to the desired location. After this has been accomplished, the sidewalls 34 can be moved outwardly so that the upper extremities engage the notches 106 in the roof. Thereafter, the corner elements 36 can be installed. The upper extremities of the sidewalls 34 and of the corner components 36 can then be secured in the notches 106 by a suitable means such as screws 201.

Figure 24:
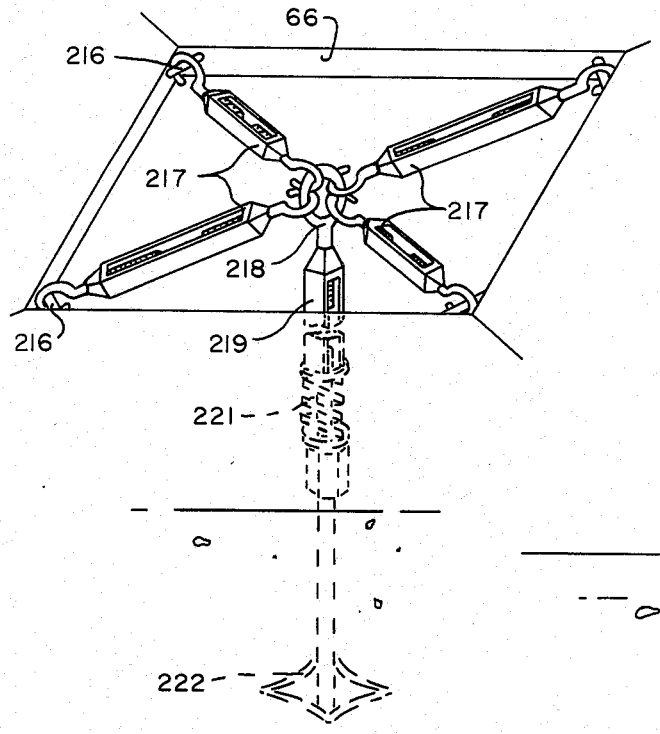
FIG. 24 is an enlarged isometric view showing the manner in which the central portion of the floor of the building is anchored.
Figure 25:
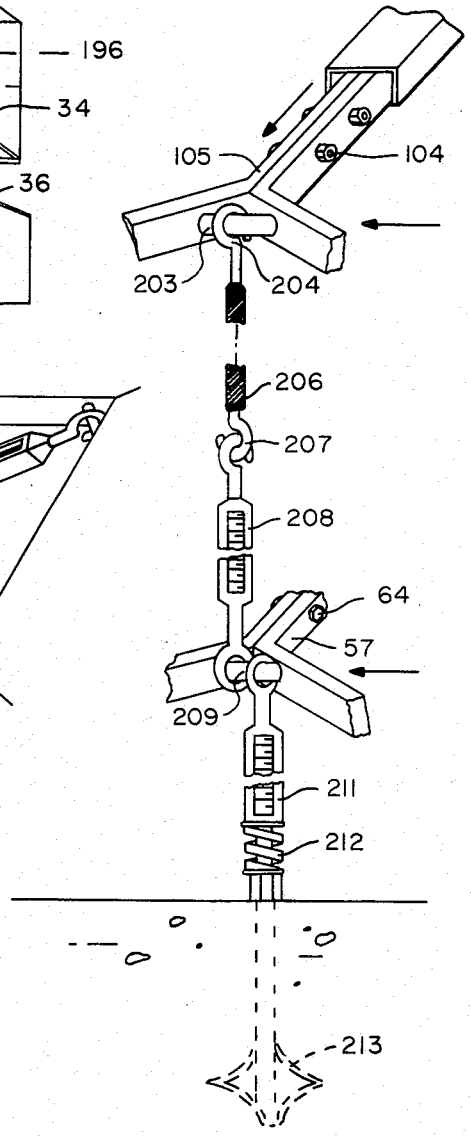
FIG. 25 is an elevational view showing the manner in which the inner corner extremities of the roof and the floor of the building are anchored to the ground.

After the erection has been completed, the entire building structure is anchored in a suitable manner. Thus as shown in FIGS. 24 and 25 there are provided pins 203 which extend through the angle members 105 forming a part of the roof. Four of such pins are provided at the four corners of the roof. Each of these pins is adapted to be engaged by a hook 204 which is secured to a non-extensible element 206 such as steel cable. The spring 206 can be secured to a cable or alternatively it can be secured to another hook 207. The hook 207 is connected to one end of a turnbuckle 208. The other end of the turnbuckle 208 can be connected to another pin 209 which extends into the angle members 57. Thus it can be seen at each of the four corners there is provided an extensible connection for securing the roof to the floor of the structure. In addition, anchoring means is provided for securing the floor 32 to the earth and consists of another turnbuckle 211 which has one end secured to the pin 209 and the other end which is secured to a coil spring 212. The spring 212 can be connected directly to a suitable earth-type anchor 213 of a conventional type.

In addition to providing the four separate corner anchors, a central anchor also can be provided for the floor. This can take the form shown in FIG. 24 in which pins 216 are provided in the four corners of the opening 66. Four turnbuckles 217 are provided. One end of each of the turnbuckles 217 is connected to the pin 216 and the other end is connected to a ring 218. Another turnbuckle 219 is provided which extends downwardly and has one end connected to the ring 218 and has the other end connected to a coil spring 221. The spring 221 is connected to a suitable ground anchor 222. Thus it can be seen that the floor 32 is securely anchored at four exterior corners as well as the center.

The plumbing fixtures provided in the dwelling shown in FIG. 1 are connected by flexible and extensible tubing to the hot and cold water lines and to the waste product lines so as to accommodate vertical raising and lowering of the entire dwelling 31 in the event of flooding. As flooding occurs, the inflatable elements 71 will float upwardly to raise the building. A certain amount of upward movement can be accommodated by the springs 212 and 221 provided as a part of the anchoring means. Additional upward movement can be accommodated by adjustment of the turnbuckles 211 and 219. Thus it can be seen that with such a construction, the dwelling can remain relatively safe in flood conditions. As soon as the flood waters subside, the inflatable elements 71 will again come in contact with the ground by the force of gravity and by the forces applied by the springs forming a part of the anchoring means. Thus it can be seen that there has been provided a safe and stable support foundation for the building which accommodates flooding. In addition the inflatable elements 71 serve as base isolators for an earthquake-proof footing or foundation.

In the event it is desired to disassemble the dwelling after a certain period of time, this can be readily accomplished by following a procedure which is just the opposite which was utilized in erection of the dwelling. Thus a crane can be utilized for raising the roof, or alternatively, inflatable elements 196 can be provided within the dwelling to raise the roof. Thereafter, the sidewall components and the corner components 34 and 36 respectively can be removed. Thereafter, the inflatable elements can be deflated to bring the roof down to the floor level. The roof can then be disassembled. Thereafter, the floor can be disassembled. The inflatable elements utilized for supporting the floor can be deflated and the entire assembly can be packaged in a container for shipment to another location or for use at another time.

From the foregoing it can be seen that by the use of sixteen basic modular components a family home containing as much as 800 square feet, large enough to enclose two bedrooms, two bathrooms, closets, a living room and dining and kitchen space plus laundry can be provided. Although the building construction has been one which can be erected on concrete footings without the use of a crane, it can be erected on inflatable elements which make it possible to elevate the entire structure in the event of flooding. The shell after it has been fabricated can be partitioned in a number of ways to obtain the desired living accommodations. The construction of the modular components is such that they are waterproof, insulated and are metal framed. They can be readily provided with the desired finish to give the desire effects as, for example, carpeting for the flooring, and wall coverings for the sidewalls. A large central opening is provided in the roof because of the truncated construction of the panels which can accommodate a heating, ventilating and air conditioning unit 226 to provide the desired heating and cooling for the dwelling. Particularly novel means has been provided for making possible connections to electrical, water and sewage facilities for the dwelling.

After the building has been constructed, the four rectangular recesses provided in the building at the foundation level can be utilized for tanks (not shown) having a rectangular configuration. Such tanks can be utilized for water storage, sewage and the like. The corner module which is to be utilized for entry to the dwelling can have a rectangular step 31 provided therein which leads to a sidewalk 232. In addition if desired a common awning 233 can be provided. If desired blocks 236 or other suitable siding can be utilized to enclose the space below the sidewalls and down to the ground as shown in FIG. 1 to increase the attractiveness of the dwelling. Suitable landscaping 237 such as provided in FIG. 2 can be readily provided.

It is apparent from the foregoing that there has been provided a building construction utilizing modular components which can be readily assembled and disassembled by unskilled labor.

I claim:

1. In a building construction supported by the ground, a floor, sidewalls mounted upon the floor, a roof supported by the sidewalls and the floor, a plurality of spaced apart inflatable flexible elements disposed between the floor and the ground and adjustable means anchoring the floor to the ground and serving to urge the floor toward the inflatable flexible elements to provide a stable and relatively level support for the floor as well as the sidewalls and roof.

2. A construction as in claim 1 wherein said floor and roof are formed of foldable components comprised of hinged panels.

3. A building construction as in claim 1 together with means for supplying electrical switches and outlets in the floor panels.

4. A building construction as in claim 2 together with means for supplying hot and cold water and waste disposal lines in the floor panels.

5. A building construction as in claim 1 wherein said adjustable means anchoring the floor to the ground includes adjustable anchoring means for securing the roof to the floor.

6. A building construction as in claim 4 wherein the water, electrical and waste disposal services are available from a central location in the floor.

7. A building construction as in claim 1 wherein the spaced apart inflatable elements are secured to the floor.

8. In a building construction supported by the ground, a floor comprised of four modular components, each of the modular components consisting of two panels and means for hinging the two panels, each of the modular components having a rectangular portion and a truncated triangular portion so that there is provided a central opening when the modular floor components are assembled into a unitary structure to provide the floor, four sidewalls mounted on the floor, four corner modules installed between the four sidewalls, and a roof formed of four modules, each of the roof modules being comprised of two panels and means for hinging the two panels, each of the roof panels having a rectangular portion and a substantially triangular portion.

9. A building construction as in claim 8 wherein said modules are provided with metal reinforcing.

10. In a bulding construction supported by the ground, a floor comprised of a plurality of modular components, each of the modular components consisting of first and second panels, each of the panels having a side edge, means for hinging the two panels so that the side edges abut each other and to permit swinging movement of the first and second panels about an axis parallel to said side edges, each of the panels having top and bottom sides, inflatable elements secured to and carried by each of the panels of the modular components whereby when the modular components are unfolded, the inflatable elements are adapted to rest upon the ground, said elements being inflatable to provide a support for the modular components, sidewalls mounted upon the floor and a roof mounted on the sidewalls.

11. A building construction as in claim 10 together with means for adjustably securing the floor to the ground and urge the floor into engagement with the inflatable elements so as to maintain the floor at a predetermined elevation and in a substantially stable horizontal plane.

12. In a method for erecting a building on the ground, placing a plurality of inflatable elements, providing a plurality of modular components for a floor having associated therewith said inflatable elements which are adapted to rest upon the ground, inflating the inflatable elements and positioning the modular components so that the inflatable elements engage the ground and support the floor above the ground and adjustably securing the floor to the ground to urge the floor into contact with the inflatable elements so as to maintain the floor at a predetermined elevation and in a substantially horizontal plane.

13. A method as in claim 12 together with the steps of erecting sidewalls on the floor and erecting a roof supported by the sidewalls and securing the roof to the floor.

14. A method as in claim 12 together with the step of erecting the roof by placing at least one inflatable element to raise the roof to the desired location, erecting sidewalls supported by the flooring and so that they underlie the roof, and deflating the at least one inflatable element so that the roof is supported by the sidewalls.

15. A method as in claim 13 together with the steps of disassembling the building after it has been erected for subsequent use.

16. In a method for erecting a building on the ground, placing a foundation-like support on the ground, providing a plurality of modular components for a floor and positioning the same upon the foundation-like support to provide a floor at a predetermined elevation in a substantially horizontal plane, placing at least one inflatable element on the floor, providing sidewalls, placing the sidewalls so that they overlie the floor and have their outer extremities pivotally secured to the floor whereby the inner extremities of the sidewalls can be moved upwardly and outwardly, providing a roof, placing the roof over the at least one inflatable element positioned on the floor, inflating the at least one element to raise the roof to the desired elevation with respect to the floor and positioning the sidewalls so that the upper extremities of the sidewalls can support the roof and thereafter deflating the at least one deflatable element so that the roof rests upon the upper extremities of the side walls.

17. A method as in claim 16, wherein the foundation-like support is provided by placing a plurality of inflatable elements on the ground, placing the floor on the last named inflatable elements, inflating the last named inflatable elements to support the floor above the ground and adjustably securing the floor to the ground to urge the floor into contact with the last named inflatable elements to maintain the floor at the predetermined elevation and in the substantially horizontal plane.

18. A method as in claim 16, together with the step of securing the roof to the floor.

* * * * *